US007226337B2

(12) United States Patent
David

(10) Patent No.: US 7,226,337 B2
(45) Date of Patent: Jun. 5, 2007

(54) PLATEN AND HEAD ROTATION RATES FOR MONITORING CHEMICAL MECHANICAL POLISHING

(75) Inventor: Jeffrey Drue David, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/402,522

(22) Filed: Apr. 11, 2006

(65) Prior Publication Data

US 2006/0183407 A1 Aug. 17, 2006

Related U.S. Application Data

(62) Division of application No. 10/643,583, filed on Aug. 18, 2003, now Pat. No. 7,025,658.

(51) Int. Cl.
*B24B 49/00* (2006.01)
*B24B 51/00* (2006.01)
*G06F 19/00* (2006.01)

(52) U.S. Cl. ..... 451/5; 451/8; 451/11; 451/41; 700/121; 700/175

(58) Field of Classification Search ..... 451/5, 451/8, 11, 41, 285–290; 700/121, 175
See application file for complete search history.

(56) References Cited

U.S. PATENT DOCUMENTS 4,005,359 A 1/1977 Smoot
4,112,365 A 9/1978 Larson et al.
4,303,885 A 12/1981 Davis et al.
4,467,281 A 8/1984 Davis et al.
4,556,845 A 12/1985 Strope et al.
4,673,877 A 6/1987 Sakamoto et al.
4,715,007 A 12/1987 Fujita et al.
5,433,651 A 7/1995 Lustig
5,559,428 A 9/1996 Li et al.
5,609,511 A 3/1997 Moriyama et al.
RE35,703 E 12/1997 Koch et al.
5,738,574 A 4/1998 Tolles et al.
5,838,447 A 11/1998 Hiyama et al.
5,949,927 A 9/1999 Tang
6,068,539 A 5/2000 Bajaj et al.
6,159,073 A 12/2000 Wiswesser et al.
6,183,354 B1 2/2001 Zuniga et al.
6,280,289 B1 8/2001 Wiswesser et al.
6,296,548 B1 10/2001 Wiswesser et al.
6,422,927 B1 7/2002 Zuniga
6,433,541 B1 8/2002 Lehman et al.

(Continued)

*Primary Examiner*—M. Rachuba
(74) *Attorney, Agent, or Firm*—Fish & Richardson

(57) ABSTRACT

Methods system and apparatus, including computer program products, for monitoring polishing a substrate. A polishing pad mounted on a platen is rotated at a first rotation rate, and a carrier head is rotated at a second rotation rate that is different from the first rotation rate. The carrier head carries a substrate and presses the substrate against the polishing pad. A sequence of data traces is acquired using a sensor mounted in the platen, wherein each data trace results from a separate scan with the sensor along a path across the substrate, and wherein the first and second rotation rates are such that a plurality of paths corresponding to a predetermined number of consecutive scans are substantially evenly radially distributed across the substrate.

10 Claims, 5 Drawing Sheets

U.S. PATENT DOCUMENTS

| | | | |
|---|---|---|---|
| 6,558,229 | B2 | 5/2003 | Kimura et al. |
| 6,707,540 | B1 | 3/2004 | Lehman et al. |
| 6,764,380 | B2 | 7/2004 | Wiswesser et al. |
| 6,857,945 | B1 | 2/2005 | Chen et al. |
| 6,924,641 | B1 | 8/2005 | Hanawa et al. |
| 6,966,816 | B2 | 11/2005 | Swedek et al. |
| 2001/0036793 | A1 | 11/2001 | Wiswesser et al. |
| 2002/0164925 | A1 | 11/2002 | Swedek et al. |
| 2003/0176081 | A1 | 9/2003 | Redeker et al. |
| 2004/0138773 | A1* | 7/2004 | Tomoyasu ..... 700/108 |
| 2004/0152396 | A1 | 8/2004 | Wiswesser et al. |
| 2005/0024047 | A1 | 2/2005 | Miller et al. |

* cited by examiner

PLATEN AND HEAD ROTATION RATES FOR MONITORING CHEMICAL MECHANICAL POLISHING

CROSS-REFERENCE TO RELATED APPLICATIONS

This application is a divisional application and claims the benefit of priority under 35 U.S.C. Section 120 of U.S. application Ser. No. 10/643,583, filed Aug. 18, 2003 now U.S. Pat. No. 7,025,658. The disclosure of the prior application is considered part of and is incorporated by reference in the disclosure of this application.

BACKGROUND

The present invention relates to monitoring during chemical mechanical polishing.

An integrated circuit is typically formed on a substrate by the sequential deposition of conductive, semiconductive or insulating layers on a silicon wafer. One fabrication step involves depositing a filler layer over a non-planar surface, and gradually removing the filler layer along a plane, i.e., planarizing the filler layer, until the non-planar surface is exposed. For example, a conductive filler layer can be deposited on a patterned insulating layer to fill the trenches or holes in the insulating layer. The filler layer is then polished until the raised pattern of the insulating layer is exposed. The portions of the conductive layer remaining between the raised pattern of the insulating layer form vias, plugs and lines that provide conductive paths between thin film circuits on the substrate. Alternatively, an outmost dielectric or semiconductor layer of a substrate can be planarized.

Chemical mechanical polishing (CMP) is one accepted method of planarization. At a polishing station, the substrate is typically mounted on a carrier head (also called polishing head) and faces a polishing pad (also called polishing disk pad or belt pad) mounted on a rotating platen. The carrier head also rotates and pushes the substrate against the polishing pad with a controllable load. The rotation rate of the platen is typically very close to the rotation rate of the carrier head to avoid uneven polishing due to a non-vanishing average of linear velocities at each point of the substrate. A polishing slurry, including at least one chemically reactive agent, can be supplied on the surface of the polishing pad.

Polishing the substrate can be monitored in situ, i.e., during polishing, or by removing the substrate from the polishing station and transferring it to a metrology station. In-situ monitoring has been implemented using, e.g., optical and/or eddy current sensors mounted in the platen. Other techniques propose monitoring friction, motor current, slurry chemistry, acoustics, or conductivity. The substrate is typically monitored for endpoint detection, i.e., detecting whether the polishing process is complete, e.g., whether a substrate layer has been planarized to a desired flatness or thickness, or when a desired amount of material has been removed.

SUMMARY

The invention provides techniques for monitoring CMP, where rotation rates of a carrier head carrying a substrate and a platen including a sensor are mismatched so that the sensor can be used to acquire measurements that correspond to substantially evenly radially distributed paths across the substrate (i.e., paths arranged like rays evenly angularly distributed around a center).

In general, in one aspect, the invention provides methods and apparatus, including computer program products, for monitoring polishing a substrate. A polishing pad mounted on a platen is rotated at a first rotation rate, and a carrier head is rotated at a second rotation rate that is different from the first rotation rate. The carrier head carries a substrate and presses the substrate against the polishing pad. A sequence of data traces is acquired using a sensor mounted in the platen, wherein each data trace results from a separate scan with the sensor along a path across the substrate, and wherein the first and second rotation rates are such that a plurality of paths corresponding to a predetermined number of consecutive scans are substantially evenly radially distributed across the substrate.

In general, in another aspect, the invention provides a system for monitoring polishing a substrate. The system includes an in-situ monitor and a data processing apparatus. The in-situ monitor has a sensor mounted in a platen rotating at a first rotation rate. The in-situ monitor is configured to acquire a sequence of data traces, wherein each data trace results from a separate scan with the sensor along a path across the substrate carried by a carrier head rotating at a second rotation rate that is different from the first rotation rate. The data processing apparatus is configured to calculate one or more characteristics of the substrate from data traces resulting from a predetermined number of consecutive scans along a plurality of paths across the substrate, wherein the first and second rotation rates are such that the plurality of paths are substantially evenly radially distributed across the substrate.

Particular implementations can include one or more of the following features. The predetermined number of consecutive scans can be less than 10, e.g., 3, 4, 5, or 6. A difference between the first and second rotation rates can be between about four and about fifteen percent of the first rotation rate, e.g., between about five and about ten percent of the first rotation rate. The difference between the first and second rotation rates can be between about forty and about sixty percent of the first rotation rate divided by the predetermined number. The ratio of the first and second rotation rates can be about a ratio of a first prime number and a second prime number. There can be a third prime number between the first and second prime numbers. Data in the sequence of data traces can be used to calculate one or more characteristics of the substrate. Polishing parameters in the carrier head can be modified based on the calculated characteristics of the substrate. An endpoint of the polishing can be detected based on the calculated characteristics of the substrate. Calculating one or more characteristics can include calculating characteristics of inhomogeneities in substantially evenly distributed radial directions across the substrate. Calculating one or more characteristics can include calculating one or more characteristic thickness values for the substrate at one or more radial distances from a center of the substrate. Acquiring a sequence of data traces using a sensor can include using the sensor to detect eddy currents and/or one or more optical properties in the substrate.

The invention can be implemented to potentially provide one or more of the following advantages. A sequence of data traces can be acquired within a few rotations of the platen such that the data traces substantially evenly radially represent the substrate. A sequence of data traces can be acquired periodically, e.g., every few seconds. The data traces can be processed to efficiently and evenly characterize the substrate. For example, data can be sorted according to radial distance from a center of the substrate for different radial directions. Data representing the same radial distance but different radial directions can be averaged to calculate average quantities, e.g., thickness, and compared to each other to estimate fluctuations around the average. The average quantities and/or the fluctuations can be used for improved endpoint detection and/or to correct polishing parameters during polishing. For example, load applied to the substrate can be selectively modified to compensate undesired differences in thickness of the substrate layer. With improved endpoint detection and correct load, polishing can avoid problems that are caused by overpolishing (e.g., removing too much of a conductive layer causing increased circuit resistance) and underpolishing (removing too little of a conductive layer causing short circuits). The rotation rates of the head and the platen can be selected to avoid "harmonics," i.e., repeatedly polishing a point in the substrate by the same portion of the pad. The data traces can be acquired using a sensor mounted in the platen, such as an optical sensor or an eddy current sensor.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
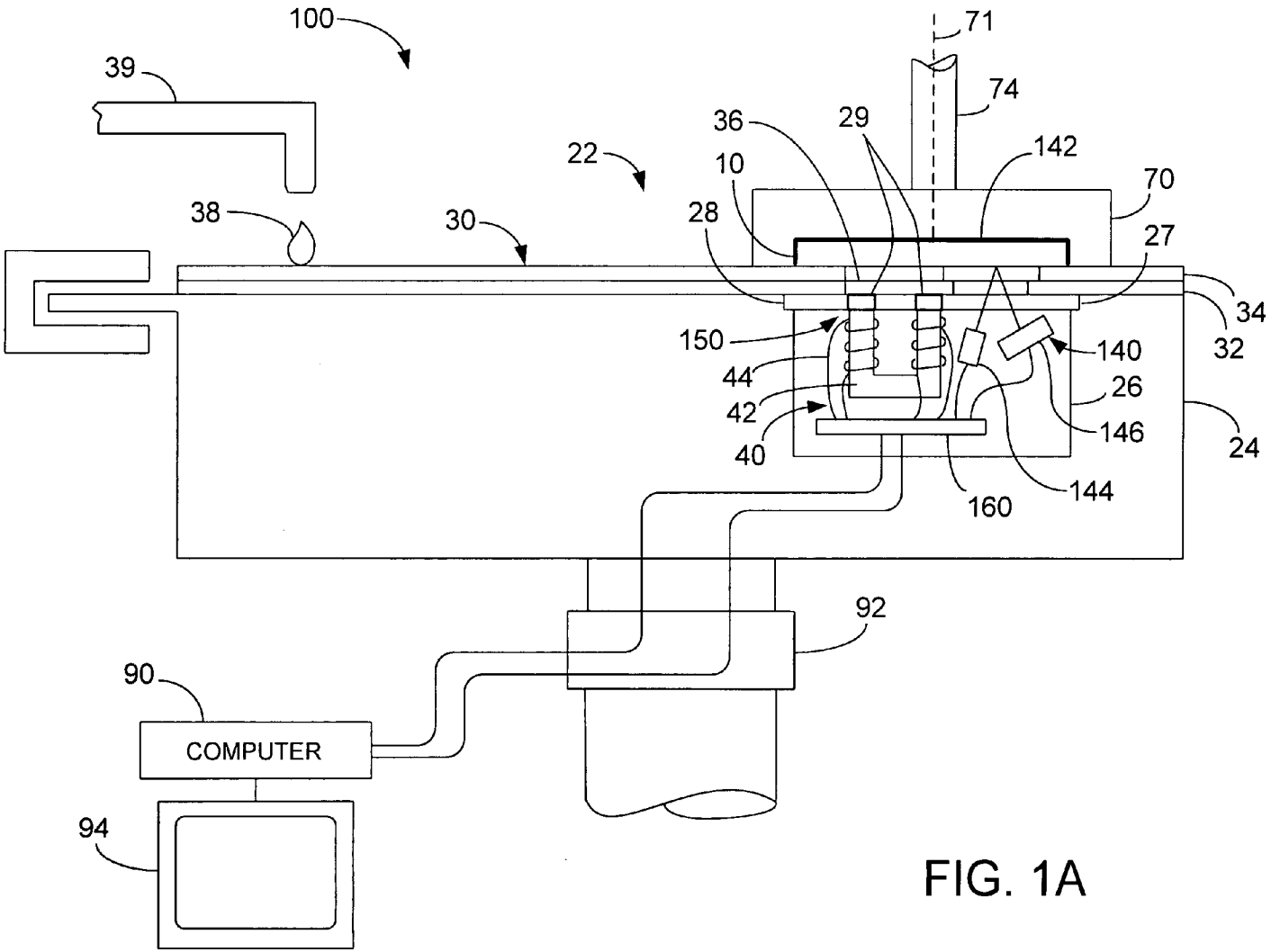
FIG. 1A is a schematic cross-section side view of a polishing station.

FIG. 1A illustrates a polishing apparatus 100 polishing a substrate 10. An exemplary apparatus is described in U.S. Pat. No. 5,738,574, the entire disclosure of which is incorporated herein by reference. The polishing apparatus 100 includes a polishing station 22 at which the substrate 10 is polished, an in-situ monitor 40 that monitors polishing the substrate 10, and a computer 90 for processing data from the in-situ monitor 40. In one implementation, the substrate 10 is a silicon wafer having a patterned dielectric layer, e.g., an oxide, that is covered by a conductive layer, e.g., a metal layer such as a copper layer. The substrate 10 is polished at the polishing station 22 to form circuit elements for an integrated circuit from conductive layer portions that remain in trenches and holes of the dielectric layer. In alternative implementations, other substrates can be polished by the polishing apparatus 100. For example, substrates in which the outmost exposed layer is a dielectric or semiconductor layer can be planarized.

The polishing station 22 includes a carrier head 70 and a platen 24. The platen 24 supports a polishing pad 30, which typically has two layers, including a backing layer 32 that abuts a surface of the platen 24 and a covering layer 34 that is used to polish the substrate 10. A polishing slurry 38 can be supplied to the surface of the polishing pad 30 by a slurry supply port or combined slurry/rinse arm 39. The carrier head 70 carries and presses the substrate 10 against the polishing pad 30. A description of a suitable carrier head 70 can be found in U.S. Pat. No. 6,422,927 or in U.S. Pat. No. 6,857,945, the entire disclosure of which are incorporated herein by reference. For example, the carrier head may include a flexible membrane with a substrate receiving surface, and three independently pressurizable concentric chambers 50, 52 and 54 behind the membrane.

During polishing, the platen 24 with the polishing pad 30 rotates about a central axis 25, and the carrier head 70 with the substrate 10 rotates about a head axis 71. Rotation of the platen 24 and the carrier head 70 are further discussed with reference to FIG. 1B.

The in-situ monitor 40 includes a sensor 150 and a drive and sense circuitry 160 in a recess 26 of the rotating platen 24. The sensor 150 detects eddy currents in one or more metal layers of the substrate 10. A suitable in-situ monitor is disclosed in U.S. Pat. No. 6,924,641, U.S. Pat. No. 6,966,816, and U.S. Publication No. 2005/0024047 A1, filed Jul. 31, 2003, the entire disclosures of which are incorporated herein by reference. The in situ monitor 40 can include an optical sensor 140 mounted in the recess 26 in addition to (or instead of) the eddy current sensor 150. The optical sensor 140 can include a light source 144 to generate a light beam 142, and a detector 146 to detect reflections of the light beam from the substrate, as discussed in U.S. Pat. No. 6,966,816.

The in-situ monitor 40 acquires data traces that can be used to characterize the substrate during polishing. The sensor 150 of the in-situ monitor 40 includes a core 42, e.g., a magnetically soft metal core. A coil 44 is wound around the core 42. The coil 44 can be driven by an oscillator in the drive and sense circuitry 160 to generate an oscillating magnetic field that extends through the polishing pad 30 into the substrate 10. The oscillating magnetic field induces eddy currents in the metal layer of the substrate. The metal layer is coupled as impedance source to the circuitry 160, and as the thickness of the metal layer changes, the eddy currents and the impedance change as well. The drive and sense circuitry 160 generates a measurement signal that depends on the impedance changes. In alternative implementations, the measurement signal can depend on other characteristics, such as optical characteristics, e.g., reflectivity, detected by a corresponding sensor (e.g., the optical sensor 140) of the in-situ monitor. The in-situ monitor samples the measurement signal to acquire data points for data traces. Each data trace is a sequence of data points corresponding to a scan of the substrate 10 with the sensor 150 during a single rotation of the platen 24. By setting appropriate rotation rates for the carrier head 70 and the platen 24, subsequent data traces can substantially evenly radially represent the substrate 10, as discussed in more detail with reference to FIGS. 2A–2D.

The acquired data traces are transmitted through a rotary electrical union 92 to the computer 90 that is located apart from the platen. The computer 90 can process the data traces to calculate characteristics, such as thickness of one or more metal layers, in the substrate 10. Based on the calculated characteristics, the computer can detect an endpoint or correct polishing parameters during polishing, as discussed in more detail with reference to FIG. 3. Optionally, user interface devices, such as a display 94, can be connected to the computer 90. The display 94 can provide information, e.g., display the calculated thickness of one or more metal layers, to an operator of the polishing apparatus.

Figure 1B:
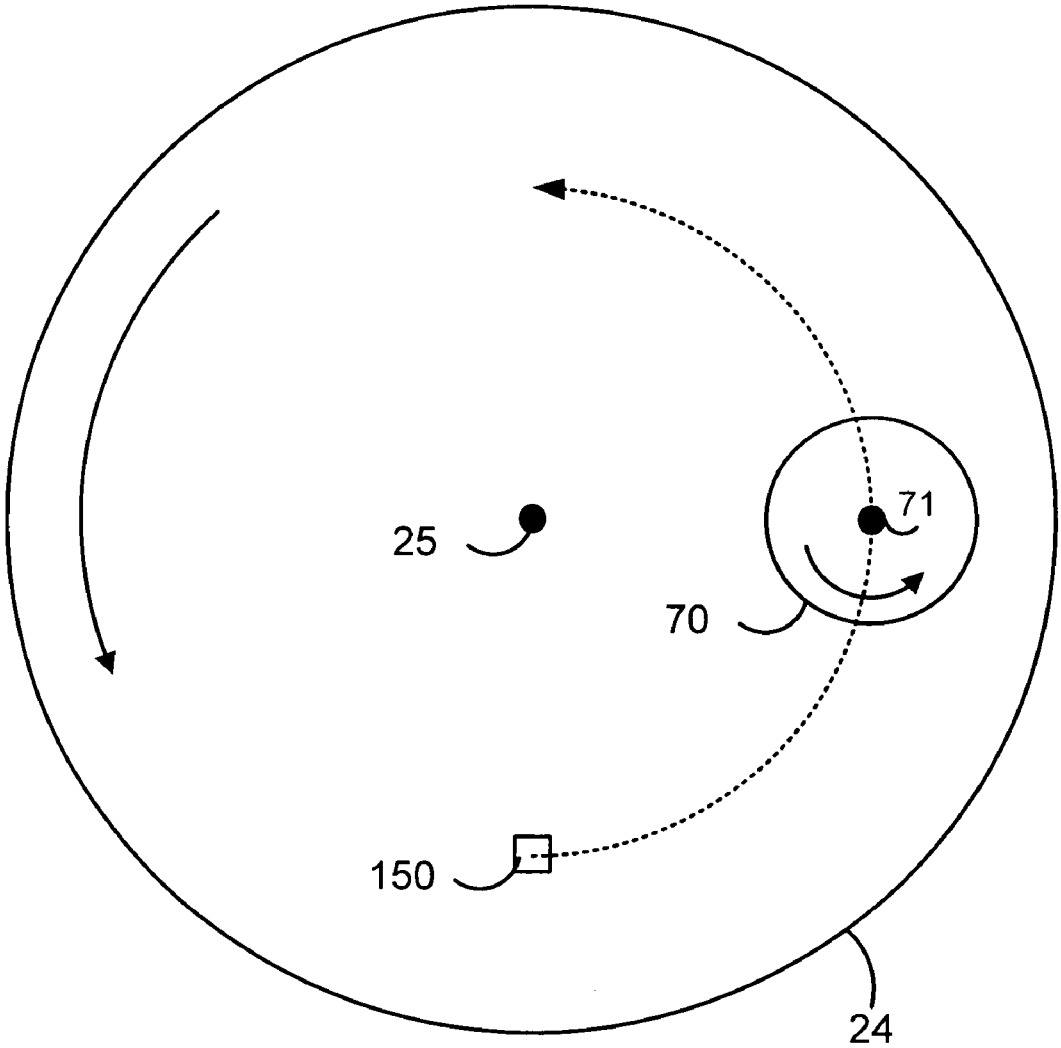
FIG. 1B is a schematic top view of a polishing station.

FIG. 1B illustrates the rotation of the platen 24 and the carrier head 70. The platen 24 rotates about the central axis 25 and the carrier head 70 rotates about the head axis 71. The central axis 25 and the head axis 71 are parallel and displaced from each other by a distance. For example, the central and head axes can be displaced by about 7.5 inches or about 12 inches. Optionally, the carrier head can be radially oscillated to change the distance between the central and head axes during polishing (this is often called "sweeping the head"). For example, the carrier head can be sweeping about ten times per minute by about half an inch, or 13 times per minute by about one inch.

The platen 24 with the polishing pad 30 rotates at a platen rotation rate, and the carrier head 70 carrying the substrate 10 rotates at a head rotation rate. Typical platen and head rotation rates are between about 50 rpm (rotation per minute) and about 115 rpm, though some polishing operations can require rotation rates that are between about 20 rpm and about 400 rpm. In typical implementations (as illustrated in FIG. 1B), the platen 24 and the carrier head 70 rotate in the same direction (e.g., corresponding to a right-hand rotation). In alternative implementations, the platen and head can rotate in opposite directions (i.e., corresponding to left and right hand rotations).

The polishing pad 30 is mounted firmly on the platen 24 so that the polishing pad 30 rotates with the platen rotation rate. As the carrier head 70 presses the substrate 10 against the polishing pad 30, the substrate 10 may rotationally slip relative to the head 70 (lateral slippage is prevented by a retaining ring of the carrier head). In most polishing operations, however, slippage is negligible and the substrate 10 rotates at the same rotation rate as the carrier head 70. In implementations where the slippage is not negligible, an average rotation rate can be estimated for the substrate (e.g., by measuring rotation of the substrate relative to the carrier head), and used in place of the head rotation rate. For example, the average rotation rate of the substrate can be smaller than the head rotation rate if the substrate lags behind the head.

The platen and head rotation rates can affect the quality of polishing. For example, a particular point of the substrate 10 has a linear velocity relative to the polishing pad 30 at each moment and, as the platen and the carrier head rotate, the relative linear velocity changes direction and amplitude. For a uniform polishing, the relative linear velocities should average to zero. This can be achieved for a single rotation of the platen if the head rotation rate is essentially equal to the platen rotation rate (and the platen and the head rotate in the same direction).

Although exactly equal rotation rates could be useful to create uniform polishing profile, the platen and head rotation rates can have a small mismatch to avoid "harmonics," i.e., repeatedly polishing a point in the substrate with the same portion of the pad at subsequent rotations of the platen. With a small mismatch, the point in the substrate will be polished at subsequent rotations by neighboring portions of the polishing pad. A typical mismatch to avoid harmonics is less than about three percent. In addition, the platen and head rotation rates can have a ratio that is a ratio of subsequent prime numbers. For example, the platen rotation rate can be 103 rpm and the head rotation rate can be 101 rpm. With a platen/head rotation ratio of large prime numbers (subsequent or not), a substrate point is polished with the same pad portion only after a large number of subsequent rotations.

Alternatively or in addition, the platen and head rotation rates can be mismatched for monitoring, as discussed below with reference to FIGS. 2A–3.

As the platen 24 rotates, the in-situ monitor 40 scans the substrate 10 at each rotation with the sensor 150 traversing beneath the substrate 10. For each scan, the in-situ monitor 40 acquires a data trace from a measurement signal that depends on features detected by the sensor 150. Each data trace includes a sequence of data points acquired by sampling the measurement signal at a substantially constant sampling rate, e.g., at 1 KHz (i.e., thousand data points per second). A suitable sampling rate can be selected based on the platen and head rotation rates and a desired number of data points that represent the substrate (i.e., data points that are acquired while the sensor 150 is underneath the substrate).

The sensor 150 has a sensing region in which features can be detected with the sensor. For the eddy current sensor 150 (FIG. 1A), the core 42 specifies a sensing region in which magnetic flux lines from the core 42 can interact with eddy currents in conductive materials, e.g., a metal layer in a substrate. For the optical sensor 140, a sensing region can be specified by a spot size of the light used to illuminate the substrate.

During each scan, the sensor's sensing region sweeps through a portion of the substrate 10 as the platen 24 and the carrier head 70 rotate. The swept-through portions specify a path across the substrate (i.e., the scan traces a path across the substrate). For example when the in-situ monitor 40 samples the signal from the sensor 150 to generate a data trace, each data point in the data trace corresponds in the substrate to a sampling zone through which the sensing region sweeps during a sampling time (which can be, e.g., the inverse of the sampling rate or a fraction of it). The sampling zones of the scan specify the path across the substrate, as further discussed with reference to FIG. 2A.

FIGS. 2A–2D illustrate exemplary paths corresponding to scans across substrates during monitoring polishing. The substrates are polished at a polishing station, such as the polishing station 22 shown in FIG. 1A, where a sensor for monitoring rotates relative to the substrates during polishing. For example, a sensor of an in-situ monitor can be mounted in a platen of the polishing station such that the sensor scans a substrate along a path as the sensor's sensing region passes through the substrate, as discussed above with reference to FIG. 1B. In the illustrated examples, each path passes through the center of a circular substrate, e.g., a circular silicon wafer with a diameter of 200 mm or 300 mm. Optionally, one or more paths can pass off the substrate's center, for example, when a carrier head holding the substrate is radially sweeping.

Figure 2A:
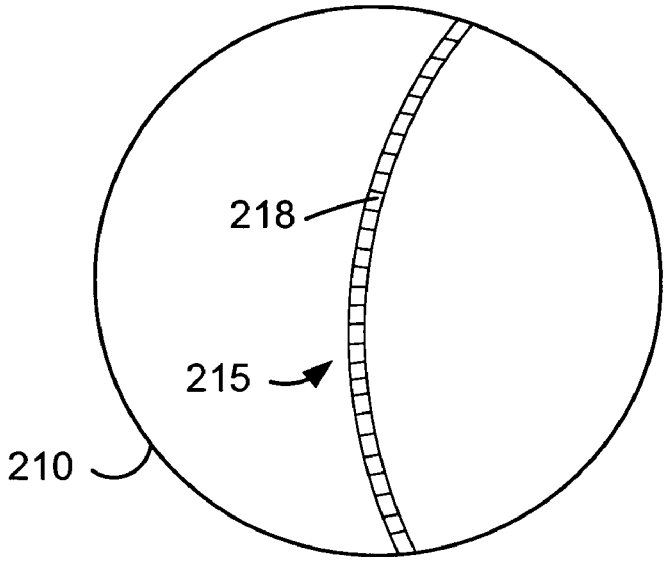
FIGS. 2A–2D are schematic diagrams illustrating exemplary paths across substrates corresponding to scans of sensors during monitoring polishing.

FIG. 2A illustrates a substrate 210 and a single path 215 of a sensor across the substrate 210 resulting from a single scan of the substrate 210 with the sensor (i. e., a single rotation of the platen carrying the sensor). During the scan with the sensor, the in-situ monitor can acquire a sequence of data points, i.e., a data trace, by sampling a measurement signal that describes features detected by the sensor. Each data point in the data trace characterizes features along a portion of the path 215 corresponding to a sampling zone 218 through which the sensor's sensing region sweeps during sampling.

The path 215 has a curved shape that is due to rotations of a platen carrying the sensor and a carrier head carrying the substrate 210. For a given diameter of the substrate 210 and a radial distance of the sensor from a central axis of the platen, the actual shape of the path 215 typically depends on platen and head rotation rates in the polishing station. If only the platen is rotating and the head rotation rate is zero, the path 215 is an arc of a circle that has a center at the central axis of the platen and a radius matching the radial distance of the sensor. If the substrate is rotated by the carrier head at a head rotation rate that is substantially equal to the platen rotation rate, the path 215 is again an arc of a circle that has the same radius as for zero head rotation rate but a different center (in particular, has an opposite curvature). For other platen and head rotation rates, the shape of the path 215 typically cannot be described by an arc of circle.

Assuming that the platen and head rotation rates are equal, multiple scans across the substrate 210 will result in the sensor following the same path 215 in each scan. This is because at equal rotation rates the same time period is required for a full rotation of the sensor and a full rotation of the substrate. After this period, the sensor and the substrate return to the same locations where they started the period. Thus for subsequent rotations, scans trace the exact same path 215. Since the sensor retraces the same path 215 each time, subsequent scans will never sample features from other portions of the substrate. Accordingly, such scans will not be able to detect polishing inhomogeneities in these non-scanned regions of the substrate.

For most polishing applications, it is desirable to update polishing parameters (e.g., load applied by the carrier head at different radius of the substrate) after a few subsequent rotations. To update polishing parameters, an in-situ monitor can use only data that is acquired during these few subsequent rotations. Assuming the platen and head rotation rates have a small mismatch, such as a couple of percent, scans during the few subsequent rotations will trace paths that have a small angular difference relative to the original path 215. Therefore, similarly to equal head and platen rotation rates, features are sampled in the substrate 210 only close to the path 215, and the scans still will not be able to detect polishing inhomogeneities.

However, substrates may have inhomogeneities in different radial directions, for example, due to structural differences at different regions of the substrate. To detect such inhomogeneities for each polishing update, the in-situ monitor needs to evenly sample the substrate between two updates. Therefore, the corresponding few scans should trace paths that are substantially evenly radially distributed, i.e., arranged like evenly distributed rays around the center of the substrate. But paths specified by subsequent scans have curvature and are subject to other constraints given by the head and platen rotation rates, and the carrier head sweep. For example, the head sweep can displace the paths from the center. Therefore, these paths are considered being substantially evenly radially distributed if scans along these paths can be used to detect inhomogeneities in different radial directions that are evenly distributed to a degree allowed by constraints on the paths, such as head sweep or curvatures of the paths.

Figure 2B:
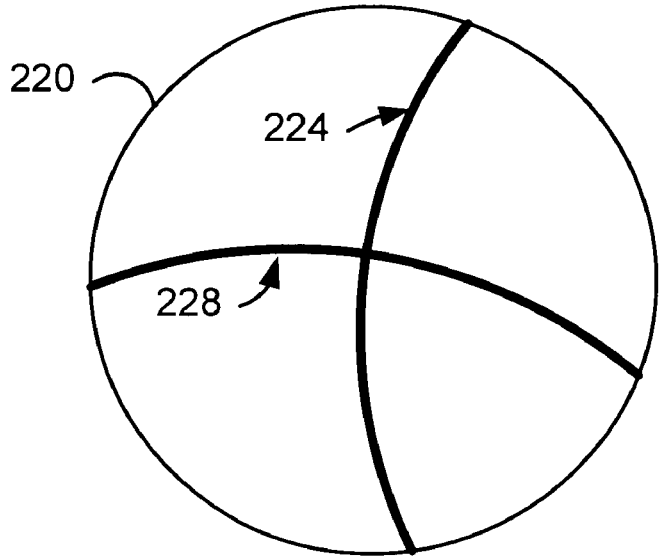
Figure 2C:
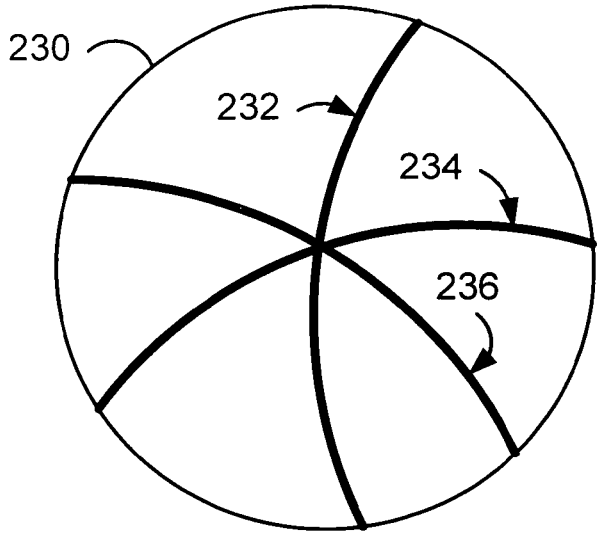
Figure 2D:
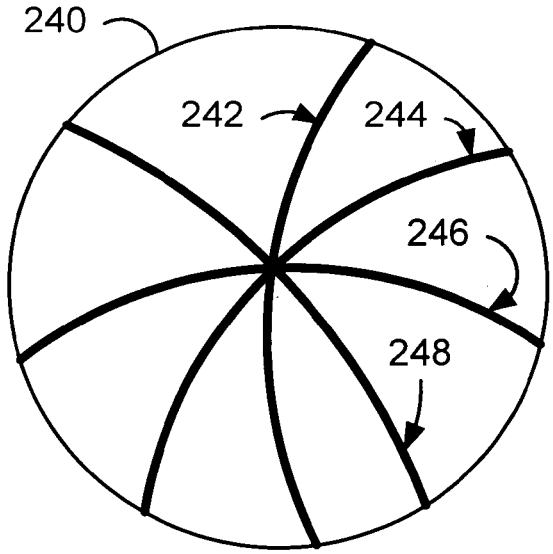

FIGS. 2B–2D illustrate examples where a predetermined number of scans specify paths that are substantially evenly radially distributed across a substrate to monitor the substrate during polishing. (These paths are illustrated without showing the corresponding sampling zones.) The measurements from the predetermined number of scans can be used to calculate characteristic parameters used to monitor polishing of the substrate, as discussed below with reference to FIG. 3.

The predetermined number of scans are acquired at subsequent rotations of a platen rotating at a platen rotation rate while the substrate is rotating at a head rotation rate. After each full rotation of the platen, the substrate rotates relative to the platen with a fraction of a full rotation, where the fraction is proportional to a difference between the head and platen rotation rates. Accordingly, this fraction of a full rotation determines a relative orientation of two paths corresponding to subsequent scans across the substrate. In alternative implementations, the predetermined number of scans can be acquired at non-subsequent rotations of the platen.

FIG. 2B illustrates two paths, i.e., a path 224 and a path 228, across a substrate 220. The paths 224 and 228 are specified by subsequent scans with a sensor. During the scans, the sensor and the substrate 220 rotate at a platen rotation rate and a head rotation rate, respectively. Each of the paths 224 and 228 has a corresponding curvature that depends, e.g., on the rotating sensor's distance from the central axis and corresponding platen and head rotation rates. The two curvatures can be substantially equal or, optionally, different (e.g., depending on whether a head carrying the substrate 220 is radially sweeping during polishing).

Despite possible minor differences of the curvature of the paths, the paths 224 and 228 are substantially evenly radially distributed across the substrate 220. That is, the paths are arranged rather like rays substantially evenly angularly distributed around a center of the substrate. For two straight lines passing through the center of the substrate, radially even distribution would imply that the lines are substantially orthogonal to each other. Similarly, if the paths 224 and 228 have a small curvature (and a small head sweep), they are characterized by substantially orthogonal tangent direction at the center of the substrate when they are substantially evenly distributed. For larger curvatures, differences become more important between two half portions of the path connecting the center and the periphery of the substrate. For example, there can be a large difference between average radial directions of the two half portion of each path. However, these paths can be still substantially evenly radially distributed if they sample the substrate in different radial directions substantially evenly as allowed by the large curvatures. In another way, the paths can be considered substantially evenly radially distributed if the resulting thickness measurements are generally evenly angularly distributed around the substrate.

In one implementation, the paths 224 and 228 correspond to about a 90-degree rotation of the substrate relative to the platen during a full rotation of the platen. This will occur when the head and platen rotation rates have a difference of about one fourth of the platen rotation rate. In addition, the head and platen rotation rates can have a ratio of non-consecutive prime numbers to avoid harmonics, such as 101 rpm platen and 73 rpm head rotation rate. For paths with different curvatures, the rotation rates can be adjusted such that subsequent scans specify substantially evenly radially distributed paths.

Alternatively, the relative orientation of the two paths 224 and 228 can be different from about 90 degrees, e.g. for paths with larger curvatures. For example, the relative orientation can take into account average directions for both halves of each path. Accordingly, the two paths 224 and 228 can deviate from orthogonality at the center of the substrate to accommodate a more even radial distribution for the different average directions of the two halves of the paths.

FIG. 2C illustrates three paths, i.e., paths 232, 234 and 236, corresponding to subsequent scans across a substrate 230 with a sensor. During the scans, the substrate 230 and the sensor rotate at a head rotation rate and a platen rotation rate, respectively. The paths 232–236 are substantially evenly radially distributed across the substrate 230. Three straight lines across the center of the substrate can be radially evenly distributed if subsequent lines have an angle of about sixty degrees relative to each other. Similarly for paths with small curvature, two subsequent paths can have about sixty degree relative angle between tangent directions at the center of the substrate 230. For paths with substantially identical curvature, sixty degree relative orientation corresponds to head and platen rotation rates with a difference of about one sixth of the platen rotation rate. In addition, the head and platen rotation rates can have a ratio of non-consecutive prime numbers to avoid harmonics, such as 101 rpm platen rotation rate and 83 rpm head rotation rate. For paths with larger curvatures, instead of about sixty degrees, another relative orientation can be set between subsequent paths, e.g., to take into account differences between radial directions of two halves of each path, and the rotation rates can be selected accordingly.

FIG. 2D illustrates four paths, i.e., paths 242, 244, 246, and 248 corresponding to subsequent scans across a substrate 240 with a sensor. During the scans, the substrate 240 and the sensor rotate at a head rotation rate and a platen rotation rate, respectively. The paths 242–248 are substantially evenly radially distributed across the substrate 240. Four straight lines across the center of the substrate can be radially evenly distributed if subsequent lines have an angle of about forty five degrees relative to each other. Similarly for paths with small curvatures, two subsequent paths can have about forty five degree relative angle between tangent directions at the center of the substrate 240. For paths with substantially identical curvature, forty five degree relative orientation corresponds to head and platen rotation rates with a difference of about one eighth of the platen rotation rate. In addition, the head and platen rotation rates can have a ratio of non-consecutive prime numbers to avoid harmonics, such as 101 rpm platen rotation rate and 89 rpm head rotation rate.

As shown in FIGS. 2B–2D as the number of scans is increasing, the curvature of the paths is becoming more important to substantially evenly radially distribute the paths. In particular, the first 242 and last 248 path have an almost opposite curvature that makes differences between radial directions of two halves of each path more pronounced. Furthermore, the angular difference between the two halves can be in the same order as the angular difference between two subsequent paths. Therefore instead of about forty five degrees, another relative orientation can be used between subsequent paths to take into account curvatures of the paths, and the rotation rates can be selected accordingly.

The examples of FIGS. 2B, 2C and 2D illustrate up to four scans that trace paths that are substantially evenly radially distributed across the sample. In alternative implementations, the number of scans can be different, for example, any other number that is about ten or less, such as five or six. For scans with an approximate platen rotation rate, a number of scans can be selected based on a maximum update time for updating monitoring parameters. For example, the approximate platen rotation rate (e.g., 60 rpm) can be multiplied with the maximum update time (e.g., 5 seconds, i.e., 5/60 of a minute) to obtain an upper limit for the number of scans (e.g., 60 times 5/60, i.e., five scans). The number of scans can be selected as the upper limit or a number that is smaller than the upper limit. Alternatively, the number of scans can be selected based on other parameters, e.g., software or hardware parameters of an in-situ monitor.

For a predetermined number of scans, the head and rotation rates can have a difference that is between about forty and about sixty percent, such as about fifty percent, of the platen rotation rate divided by the predetermined number. For an approximate platen rotation rate of 100 rpm and five scans, the platen and head rotation rates can have a difference of about one half (i.e., fifty percent) of 100 rpm divided by five, i.e., about ten rpm. In addition, the head and platen rotation rates can have a ratio of non-consecutive prime numbers, such as 107 rpm platen rotation rate and 97 rpm head rotation rate.

Figure 3:
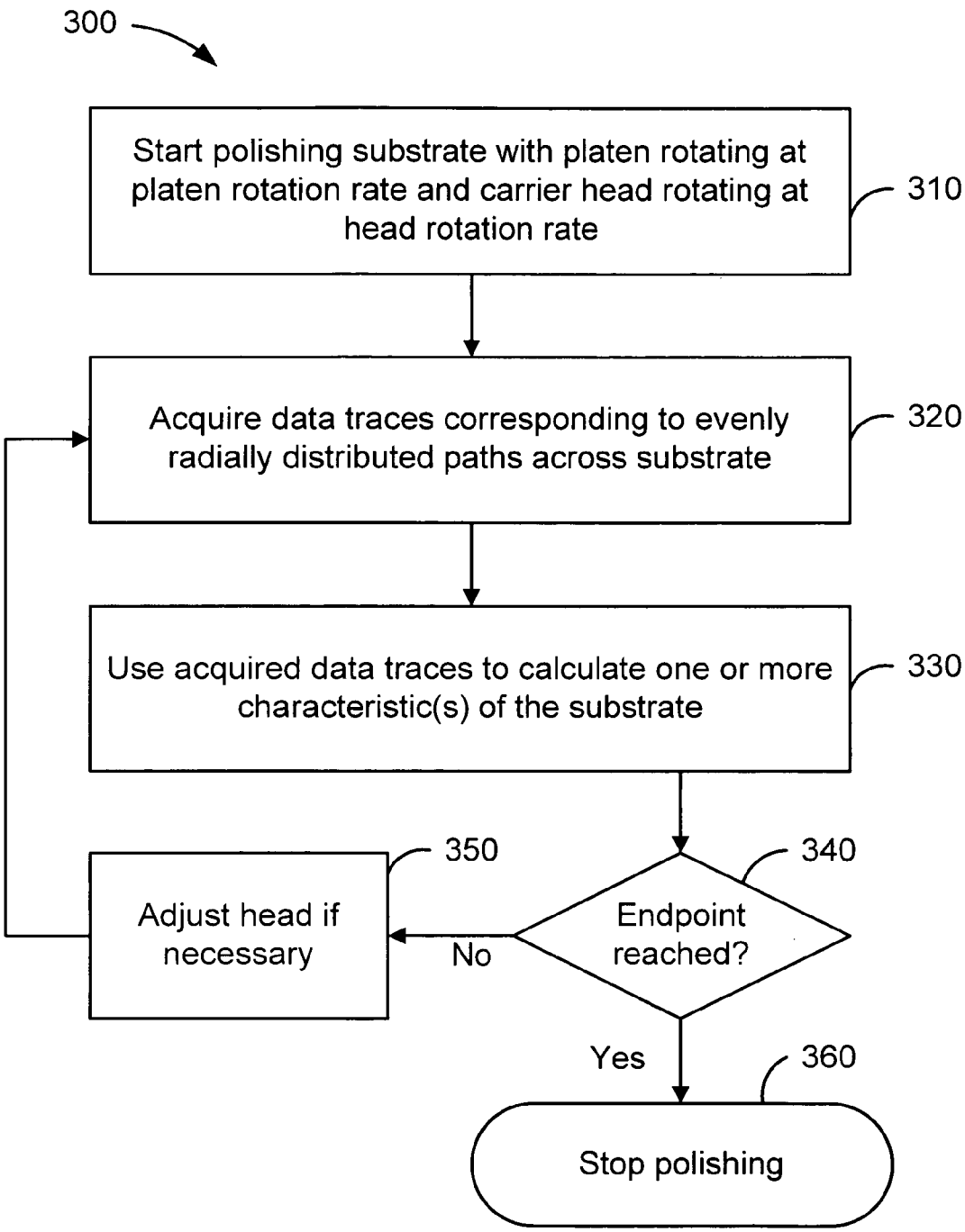
FIG. 3 is a schematic flow diagram illustrating a method for monitoring polishing a substrate.

FIG. 3 illustrates a method 300 for monitoring polishing a substrate. The method 300 can be performed by a system that includes data processing apparatus, e.g., a computer, in a polishing apparatus, such as the polishing apparatus 100 shown in FIG. 1A. The polishing apparatus includes a carrier head rotating and pressing the substrate against a polishing pad, which is resting on a rotating platen. The polishing apparatus further includes an in-situ monitor using one or more sensors, such as an eddy current and/or an optical sensor, in the rotating platen to scan the substrate.

The system starts polishing the substrate (step 310). During polishing, the platen rotates at a platen rotation rate and the carrier head rotates at a head rotation rate, where the platen and head rotation rates are different. The platen and head rotation rates can be set by an operator of the system, or can be automatically selected by the system based on other parameters of the polishing. For example, the system can use a look-up table or calculate the platen and head rotation rates based on an approximate rotation rate set for polishing the substrate. In one implementation, the system displays one or more pairs of suggested platen and head rotation rates that can be used to polish the substrate and the system operator selects one of the suggested pairs.

The system acquires a number of data traces from scans tracing a number of substantially evenly radially distributed paths across the substrate (320). Each data trace is acquired by a scan of the substrate with one or more sensors at a corresponding rotation of the platen. The number of data traces is preset according to the platen and head rotation rates such that the number of subsequent scans correspond to paths that are substantially evenly radially distributed across the substrate, as discussed above, with reference to FIGS. 2A–2D.

The system uses the acquired data traces to calculate one or more characteristics of the substrate (step 330). In one implementation, the system calculates thickness of one or more conductive layers at different radial positions in the substrate from data traces acquired with an eddy current sensor, such as the sensor 150 shown in FIG. 1A. The system can sample one or more signals from the eddy current sensor to acquire measurements for data points in the data traces, where each data point corresponds to a measurement in a sampling zone in the substrate. The data points in each data trace can be sorted according to radial positions of the corresponding sampling zones in the substrate, and the data points from different scans corresponding substantially to the same radial positions can be used to characterize thickness of the metal layers as a function of the radial position in the substrate 10. For example, the system can calculate an average thickness and fluctuations, e.g., minimum and/or maximum thickness, about the average thickness as a function of radial positions. Alternatively or in addition, the system can acquire optical data with one or more optical sensors in the platen, and use the optical data to calculate characteristics of the substrate.

Based on the calculated characteristics, the system determines whether an endpoint of the polishing is reached (decision 340). For example, the system can decide based on comparisons of average, minimum, and/or maximum thickness of a metal layer to one or more threshold values. By using characteristics that are calculated from scans tracing paths that are substantially evenly radially distributed across the substrate, the endpoint detection becomes more effective. For example, in determining the radial thickness profile of the substrate as a function, the system will use thickness measurements that are evenly angularly distributed around the substrate. Thus, an average thickness for a particular radial zone will include any thickness fluctuations that have occurred in different radial directions. Consequently, the endpoint detection algorithm is less likely to be tricked by radially asymmetric fluctuations in the polishing rate, and as a result, the endpoint detection algorithm is more reliable and the risk of overpolishing and/or underpolishing is reduced. Alternatively, the measurements from the evenly radially distributed paths can be evaluated in order to characterize a radially asymmetric fluctuations in the polishing rate.

If the endpoint is not reached, ("No" branch of decision 340), the system can use the calculated characteristics to adjust the carrier head if necessary (step 350). For example, load applied to the substrate can be selectively modified to compensate undesired differences in thickness of the substrate layer.

The system acquires further data traces (i.e., returns to step 320) to update the calculated characteristics of the substrate. To efficiently monitor polishing, parameters for the carrier head need to be updated and the endpoint detection performed frequently, such as every few seconds, e.g., every five seconds. Accordingly, the platen and head rotation rates are selected such that they allow to perform a sufficient number of scans tracing paths that are substantially evenly radially distributed across the substrate, as discussed above with reference to FIGS. 2A–2D. When the system determines that the endpoint is reached ("Yes" branch of decision 340), the system stops polishing the substrate (step 360).

A number of embodiments of the invention have been described. Nevertheless, it will be understood that various modifications may be made without departing from the spirit and scope of the invention. Accordingly, other embodiments are within the scope of the following claims.

What is claimed is:

1. A software product, tangibly embodied in a machine-readable medium, for monitoring polishing a substrate, the software product comprising instructions operable to cause one or more data processing apparatus to perform operations comprising:

receiving a sequence of data traces acquired by an in-situ monitor having a sensor mounted in a platen rotating at a first rotation rate, each data trace resulting from a separate scan with the sensor along a path across the substrate carried by a carrier head rotating at a second rotation rate that is different from the first rotation rate; and calculating one or more characteristics of the substrate from data traces resulting from a predetermined number of consecutive scans along a plurality of paths across the substrate, wherein the first and second rotation rates are such that the plurality of paths are substantially evenly radially distributed across the substrate.

2. The software product of claim 1, wherein the predetermined number of consecutive scans is less than 10.

3. The software product of claim 1, wherein the predetermined number of consecutive scans is 3, 4, 5 or 6.

4. The software product of claim 1, wherein a difference between the first and second rotation rates is between about four and about fifteen percent of the first rotation rate.

5. The software product of claim 1, wherein a difference between the first and second rotation rates is between about forty and about sixty percent of the first rotation rate divided by the predetermined number.

6. The software product of claim 1, wherein the ratio of the first and second rotation rates is about a ratio of a first prime number and a second prime number.

7. The software product of claim 1, wherein there is a third prime number between the first and second prime numbers.

8. The software product of claim 1, further comprising instructions operable to cause one or more data processing apparatus to perform operations comprising:

calculating modified polishing parameters for the carrier head based on the calculated characteristics of the substrate.

9. The software product of claim 1, further comprising instructions operable to cause one or more data processing apparatus to perform operations comprising:

detecting an endpoint of the polishing based on the calculated characteristics of the substrate.

10. The software product of claim 1, wherein the calculated characteristics include one or more characteristics that characterize inhomogeneities in substantially evenly distributed radial directions across the substrate.

* * * * *